US009706317B2

(12) United States Patent
Mustiere et al.

(10) Patent No.: US 9,706,317 B2
(45) Date of Patent: Jul. 11, 2017

(54) PACKET LOSS CONCEALMENT TECHNIQUES FOR PHONE-TO-HEARING-AID STREAMING

(71) Applicant: Starkey Laboratories, Inc., Eden Prairie, MN (US)

(72) Inventors: Frederic Philippe Denis Mustiere, Chaska, MN (US); Mohammed Reza Movahedi, Eden Prairie, MN (US); Tao Zhang, Eden Prairie, MN (US); Jon S. Kindred, Minneapolis, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 14/854,704

(22) Filed: Sep. 15, 2015

(65) Prior Publication Data

US 2016/0119725 A1 Apr. 28, 2016

Related U.S. Application Data

(60) Provisional application No. 62/068,404, filed on Oct. 24, 2014.

(51) Int. Cl.

| | |
|---|---|
| ***G10L 19/005*** | (2013.01) |
| ***H04R 25/00*** | (2006.01) |
| *G10L 25/12* | (2013.01) |

(52) U.S. Cl.

CPC ..... *H04R 25/554* (2013.01); *G10L 19/005* (2013.01); *H04R 25/305* (2013.01); (Continued)

(58) Field of Classification Search

CPC .... H04R 25/554; H04R 25/552; G10L 19/005
See application file for complete search history.

(56) References Cited

U.S. PATENT DOCUMENTS

| | | | | |
|---|---|---|---|---|
| 8,457,952 | B2 | 6/2013 | Chen et al. | |
| 2004/0083110 | A1* | 4/2004 | Wang | G10L 19/005 704/500 |

(Continued)

FOREIGN PATENT DOCUMENTS

| | | | |
|---|---|---|---|
| EP | 2133867 | A1 | 12/2009 |
| WO | WO-0063885 | A1 | 10/2000 |

OTHER PUBLICATIONS

Etter, Walter. "Restoration of a discrete-time signal segment by interpolation based on the left-sided and right-sided autoregressive parameters." IEEE Transactions on Signal Processing 44.5 (1996): 1124-1135.*

(Continued)

*Primary Examiner* — Jialong He
(74) *Attorney, Agent, or Firm* — Schwegman, Lundberg & Woessner, P.A.

(57) ABSTRACT

Embodiments of packet loss concealment for phone-to-hearing-aid streaming are generally described herein. A method for packet loss concealment can include receiving a first frame at a hearing assistance device, determining, at the hearing assistance device, that a second frame was not received within a predetermined time, and determining a first set of sequential samples that match the first frame. The method can include cross-fading the first frame and the first set of sequential samples to create a first cross-faded frame and extrapolating a third frame to replace the second frame using the first set of sequential samples and an autoregressive model.

20 Claims, 7 Drawing Sheets

(52) U.S. Cl.
CPC ..... *H04R 25/43* (2013.01); *G10L 25/12* (2013.01); *H04R 2225/43* (2013.01)

(56) References Cited

U.S. PATENT DOCUMENTS

| | | | | |
|---|---|---|---|---|
| 2005/0091048 | A1* | 4/2005 | Thyssen | G10L 19/005 704/223 |
| 2005/0166124 | A1* | 7/2005 | Tsuchinaga | G10L 19/005 714/776 |
| 2005/0240402 | A1* | 10/2005 | Kapilow | G10L 19/005 704/229 |
| 2007/0274550 | A1* | 11/2007 | Baechler | H04R 25/554 381/315 |
| 2008/0040122 | A1 | 2/2008 | Chen et al. | |
| 2009/0037168 | A1 | 2/2009 | Gao | |
| 2011/0022924 | A1* | 1/2011 | Malenovsky | G10L 19/005 714/752 |
| 2011/0208517 | A1* | 8/2011 | Zopf | G10L 21/04 704/211 |
| 2012/0314890 | A1* | 12/2012 | El-Hoiydi | H04R 25/558 381/315 |
| 2013/0129126 | A1* | 5/2013 | Callias | H02J 7/345 381/315 |
| 2014/0169599 | A1* | 6/2014 | Solum | H04R 25/554 381/315 |
| 2014/0170979 | A1* | 6/2014 | Samanta Singhar | G10L 25/60 455/41.2 |
| 2015/0255079 | A1* | 9/2015 | Huang | G10L 19/0017 704/500 |

OTHER PUBLICATIONS

"European Application Serial No. 15191332.4, Extended European Search Report mailed Mar. 14, 2016", 8 pgs.

Adler, Amir, et al., "Audio Inpainting", IEEE Transactions on Audio, Speech, and Language Processing, (2011), 12 pgs.

Bayram, I., et al., "A simple Prior for Audio Signals", IEEE Transactions on Audio, Speech, and Language Processing, (2013).

Chen, Juin-Hwey, "Packet Loss Concealment based on Extrapolation of Speech Waveform", Proceedings of the 2009 IEEE International Conference on Acoustics, Speech and Signal Processing (ICASSP 2009), (2009).

Chen, Juin-Hwey, "Packet Loss Concealment for Predicitive Speech Coding Based on Extrapolation of Speech Waveform", Conference Record of the Forty-First Asilomar Conference on Signals, Systems and Computers, (2007).

Emre, Gündüzhangunduzhan, et al., "A Linear Prediction Based Packet Loss Concealment Algo rithm for PCM Coded Speech", IEEE Transactions on Speech and Audio Processing, IEEE Service Center, New York vol. 9, No. 8, (Nov. 1, 2001).

Fink, Marco, et al., "Comparison of various predictors for audio extrapolation". Proc. of the 16th Int. Conference on Digital Audio Effects (DAFx-13), Maynooth, Ireland, (Sep. 2013), DAFX1-8.

Goodman. D., et al., "Waveform Substitution Techniques for Recovering Missing Speech Segments in Packet Voice Communications", IEEE Transactions on Acoustics, Speech, and Signal Processing, vol. ASSP-34. No. 6, (Dec. 1986).

Miralavi, S R. et al., "Packet loss replacement in voip using a recursive low-order autoregressive model-based speech", Systems, Signals and Devices (SSD), 2011 8th International Multi-Conference on,IEEE, (Mar. 22, 2011), 1-4.

Serizawa, M., et al., "A packet loss concealment method using pitch waveform repetition and internal state update on the decoded speech for the sub-band ADPCM wideband speech codec". Proceeding of 2002 IEEE Workshop on Speech Coding, (2002).

Shetty, Niranjan, et al., "Packet Loss Concealment for G.722 using Side Information with Application to Voice over Wireless LANs", Journal of Multimedia, vol. 2, No. 3, (Jun. 2007), 66-76.

Suzuki, Masanobu, et al., "A Voice Transmission Quality Improvement Scheme for Personal Communication Systems—Super Mute Scheme", Tech. report, IEEE., (1995).

Thyssen, J., "A Candidate for the ITU-T G.722 Packet Loss Concealment Standard", Proceeding of the 2007 Acoustics, Speech and Signal Processing (ICASSP 2007), (2007).

Vos, Koen, "A Fast Implementation of Burg's Method", (Aug. 2013), 3 pgs.

Watkins, C.R., "Improving 16 kb/s G.728 LDCELP Speech Coder for Frame Erasure Channels", Proc. IEEE Int. Conf. Acoustics, Speech, Signal Processing, (May 1995), 241-244.

* cited by examiner

PACKET LOSS CONCEALMENT TECHNIQUES FOR PHONE-TO-HEARING-AID STREAMING

CLAIM OF PRIORITY

This patent application claims the benefit of U.S. Provisional Patent Application No. 62/068,404, filed Oct. 24, 2014, entitled "PACKET LOSS CONCEALMENT TECHNIQUES FOR PHONE-TO-HEARING-AID STREAMING", which is incorporated by reference herein in full.

FIELD OF THE INVENTION

Disclosed herein are devices and methods for packet loss concealment in device-to-device streaming, and in particular for streaming to a hearing aid.

BACKGROUND

Adaptive differential pulse-code modulation (ADPCM) is used in the context of audio streaming to improve hearing assistance device functionality when streaming from a remote device to a hearing assistance device. ADPCM has a low latency, good quality, a low bitrate, and low computational requirements. However, one drawback to using ADPCM is that it is negatively affected by packet-loss. The negative impact on resulting audio quality when packet-loss occurs with ADPCM is not limited to the dropped packet, but also up to several dozens of milliseconds after the dropped packet.

When using ADPCM, the encoder and the decoder both maintain a certain state based on the encoded signal which, under normal operation and after initial convergence, is the same. A packet drop causes the encoder and the decoder states to depart from one another, and the decoder state will take time to converge back to the encoder state once valid data is available again after a drop.

Packet-loss-concealment (PLC) techniques mitigate the error caused by packet loss. While there are multiple single-channel PLC techniques currently used, they are often slow and costly in terms of instructions per second used, and thus can be infeasible in a hearing assistance device setting.

SUMMARY

Disclosed herein are devices and methods for packet loss concealment for streaming to a hearing assistance device. In various embodiments, a method for packet loss concealment includes receiving a first frame at a hearing assistance device, determining, at the hearing assistance device, that a second frame was not received within a predetermined time, and determining a first set of sequential samples that match the first frame. The method can include cross-fading the first frame and the first set of sequential samples to create a first cross-faded frame and extrapolating a third frame to replace the second frame using the first set of sequential samples and an autoregressive model.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

BRIEF DESCRIPTION OF THE DRAWINGS

In the drawings, which are not necessarily drawn to scale, like numerals can describe similar components in different views. Like numerals having different letter suffixes can represent different instances of similar components. The drawings illustrate generally, by way of example, but not by way of limitation, various embodiments discussed in the present document.

DETAILED DESCRIPTION

The following detailed description of the present subject matter refers to subject matter in the accompanying drawings which show, by way of illustration, specific aspects and embodiments in which the present subject matter can be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

Adaptive differential pulse-code modulation (ADPCM) is useful for improving hearing assistance device functionality when streaming from device-to-device, but is particularly susceptible to packet loss issues. Packet-loss-concealment (PLC) techniques are therefore used to mitigate the error caused by packet loss.

In an example, a hearing assistance device can use a codec to decode audio. For example, a G.722 audio codec according to an International Telecommunication Union Telecommunication Standardization Sector (ITU-T) standard can be used in an ADPCM system to decode audio. Other codec apparatus and methods can be used without departing from the scope of the present subject matter.

Figure 1:
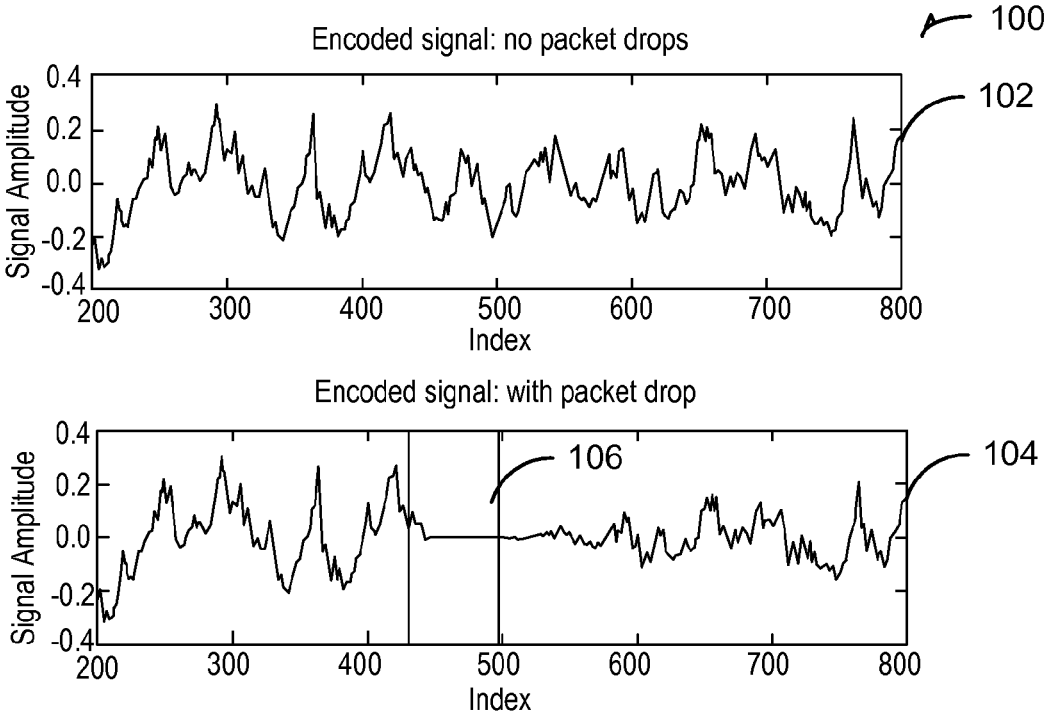
FIG. 1 illustrates generally a graph showing effects of a packet loss on an encoded signal in accordance with some embodiments of the present subject matter.

FIG. 1 illustrates generally a graph 100 showing effects of a packet loss on an encoded signal in accordance with some embodiments of the present subject matter. The graph 100 includes signals encoded using an ADPCM-based codec. The graph 100 includes a first encoded signal 102 over time with no packet loss and a second signal 104 over time with a packet loss. The packet loss is highlighted on the graph 100 of the second signal 104 with a box 106. As is evident from the second signal 104, the packet loss affects the signal not only at, but also after, the packet loss highlighted by box 106. The effect of the packet loss is not confined to just the window of the lost packets, but beyond. In an example, a PLC technique includes artificially "filling" the blank caused by the packet drop with a filler signal that is thought to naturally extend the signal with one that is similar enough to the original signal that was encoded at the encoder. This replacement signal is sometimes called a concealment frame, and there exists a wide range of solutions to generate it.

In an ADPCM-based system, the mere generation of a filler does not always remove the state inconsistencies, which can potentially create long-lasting and highly audible artifacts. In an example, re-encoding the synthetic concealment frame at the decoder can be used to avoid artifacts. This allows for the decoder's state to keep updating, and with an appropriate "filler" signal, its state will not drift too far from the encoder's state at the end of the frame.

One method to generate a concealment frame is the so-called "pitch-repetition" method. In an example, the last 20 milliseconds of audio are stored in a circular buffer, and from this data an estimate of the pitch is tracked (essentially by doing a brute-force search from circular delays of 5 to 15 milliseconds, using a maximum correlation-based method). When a dropped frame is detected by the decoder, a 10-millisecond concealment frame is generated synthetically from a repetition of the last pitch period. Some windowing and overlap-add can also be employed to ensure smooth transitions between the real and synthetic signals, and slight structural changes in the decoder can be made. However, repeating the last full pitch period can have a negative impact in quality for erroneously detected pitch. Moreover, repeating the exact same pitch period for more than 10 milliseconds (e.g. if multiple frames are dropped) will also typically sound very synthetic, and even more so if there are significant discontinuities at the frame borders (e.g., due to badly estimated pitch). To address the latter issue, if additional latency is acceptable then some type of cross-fading between the filler and the previous or the next correct frame(s) can be introduced.

In an example, an "enhanced" pitch repetition method can be used, where multiple additional tricks are used to improve the resulting quality, including: using the so-called "ringing signal" (e.g., the first few samples coming out of the synthesis filter with zero-input, as seen right after the beginning of box 106 at the bottom of FIG. 1) to overlap-adds it to a periodic waveform extension of the previous frame; time-warping and re-phasing (to improve alignment between concealment frame and the previous/next valid data); classification of the previous frame just before the loss as either voice-like or noise-like; gradual gain attenuation as more and more frames are lost (so that after 60 milliseconds, the output is in fact practically muted), and other tricks that can be used if possible, such as re-alignment once the next frame is present.

In another example, a low-complexity PLC technique can be used, which can include a tradeoff of lower quality for less complexity. It can introduce short and long-term predictors that it uses to generate the extrapolated signal, it can "over-extrapolate" to cover the next available frame for cross-fading, or the like. It can include higher quality for music signals.

In yet another example, in order to minimize state disparities following a frame loss, additional information can be sent with a frame, indicative of the state of the encoder. This greatly speeds up the re-synchronizing process and reduces artifacts when a correct frame is received again. This example technique can also employ pitch repetition to fill the blank left during the frame loss. However there is an additional bandwidth cost with this method and it is not compatible with typical ADPCM encoders.

In an example, a technique for packet loss concealment can include all-pole modelling an arbitrary length of buffered audio data for packet loss concealment. The technique can include an appropriate filter initialization, and letting the resulting filter "ring" for the duration of the blank. In various examples, the Burg method can be used for a high output quality, and the Yule-Walker method can be used for a lighter computational burden to calculate or estimate autoregressive parameters. There are many methods to determine autoregressive parameters, and other methods besides Yule-Walker method and Burg method can be used without departing from the scope of the present subject matter. After the waveform has been generated, the internal state of the decoder can be updated by re-encoding it. In an example, this re-encoding is well indicated as the extrapolated waveform is typically very close to the true waveform (at least for the first few milliseconds of data), and therefore the decoder's state is adequately updated.

Figure 2:
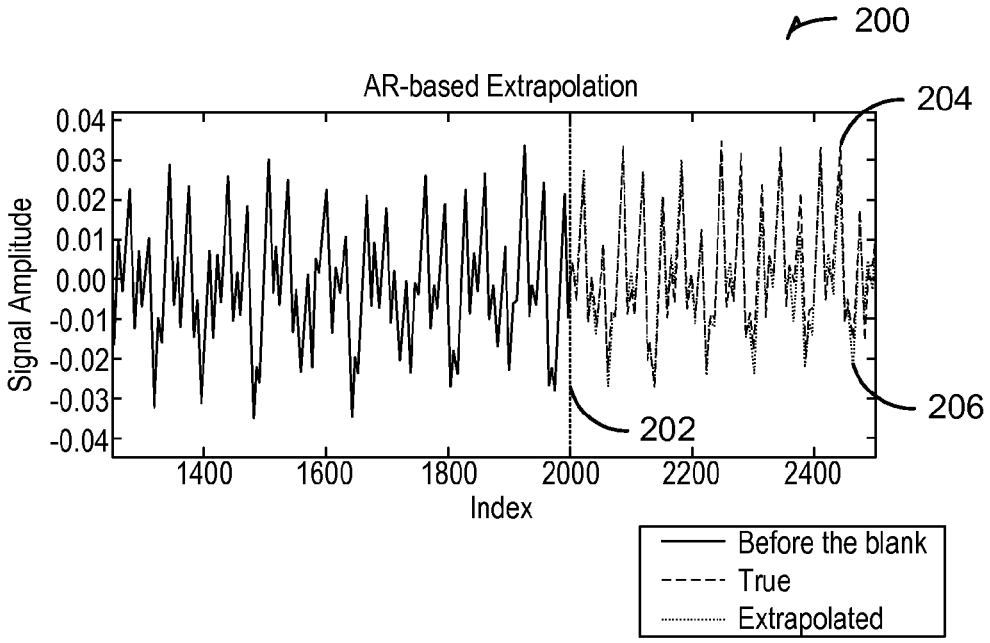
FIG. 2 illustrates generally a graph showing an autoregressive-based technique for extrapolation of an audio signal in accordance with some embodiments of the present subject matter.

FIG. 2 illustrates generally a graph 200 showing an autoregressive-based technique for extrapolation of an audio signal in accordance with some embodiments of the present subject matter. In a specific example, graph 200 can include an autoregressive extrapolation of a 16 kHz audio signal. The audio is interrupted at cut-off point 202, at which point the extrapolation occurs. In this example, the autoregressive (AR) order is 100, and the first 200 samples are used to determine the AR model. The extrapolation length is 500 samples. After the cut-off point 202, the extrapolated signal 204 and the true signal 206 are shown. The extrapolated signal 204 closely tracks the true signal 206. In a packet loss situation, the true signal 206 would be missing, and the extrapolated signal 204 would be substituted for the missing true signal 206.

In one embodiment, when the model order is large-enough and well initialized, this technique produces high quality extrapolation and can be easily augmented to "latch" onto future available data by cross-fading. This technique also does not induce additional latency since the forward extension is very natural-sounding for several dozens of milliseconds.

This technique can have a large computational complexity involved in determining autoregressive parameters. The technique can include large AR model orders (e.g., more than 50), which makes it difficult to include in current fixed-point processors. Using the large AR model orders, the technique produces results that are of markedly higher quality than previous techniques. Estimations techniques, increased processor capabilities, and modeling data can be used to implement this technique in hearing assistance devices, including at lower orders using less computational complexity.

Various embodiments include concealing a source of artifacts and non-naturalness in discontinuities in the reconstructed signal as described below. One component of the technique includes pattern matching, and includes further operations to enforce a smooth and natural-sounding extrapolation. An assumption can be made that the decoder is aware of whether or not the next frame is valid or dropped, and an "extrapolated data" buffer can be available.

Figure 3:
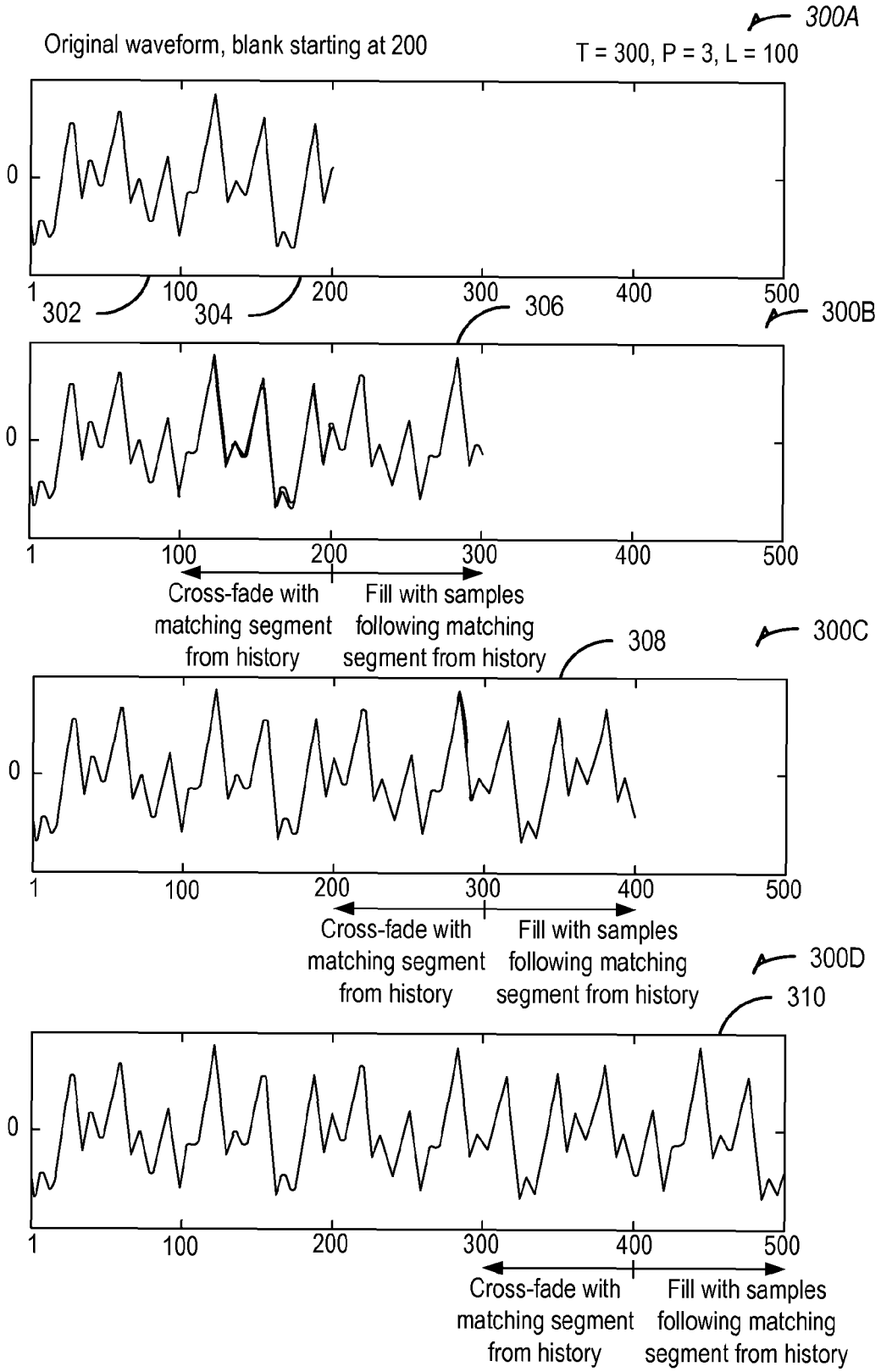
FIG. 3 illustrates generally graphs of cross-faded waveforms with filled in frames in accordance with some embodiments of the present subject matter.

FIG. 3 illustrates generally graphs 300A-300D of cross-faded waveforms with filled in frames in accordance with some embodiments of the present subject matter. For an incoming frame, the technique can include, if the current frame 304 is valid (i.e., not dropped), first decoding the frame normally (without playing it back yet). If the previous frame 302 was not valid (i.e., dropped), the current frame can be cross-faded using the data just decoded above with the data present in the extrapolated data buffer over the entire frame. In the example shown in graph 300A, the previous frame 302 is valid, so no cross-fading need take place. The technique can continue by determining if the next frame 306 is dropped, and if so (as is the case, as shown in graph 300A), then beginning a specific form of extrapolation that will generate artificial data over the 2 next future frames (e.g., 308 and 310), and modify the current frame 304 (as shown in graph 300B, where the current frame 304 is cross-faded with a matching segment from history). This can be done whether the next frame 306 is freshly decoded from a valid frame or from past extrapolations. If the current frame 304 is dropped, the technique can proceed without additional decoding and playback the audio data currently available in the "extrapolated data" buffer at the correct indices.

FIG. 3 shows a technique for smoothly extending a waveform from time index 200 to 500 (e.g., over frames 306, 308, and 310), using 3 iterations as shown in graphs 300B, 300C, and 300D. In this particular example, there are 3 matching tasks and 3 cross-fading operations. The 2 later matching tasks (those shown in graphs 300C and 300D), can be simplified as discussed below. For example, an assumption can be made that the locations of the later matching segments are likely known from the first search results. In an example, frames 308 and 310 can be extrapolated with less computational effort than that used to extrapolate frame 306. For example, frame 308 can include a matched segment that immediately follows the matched segment for extrapolated frame 306 and frame 310 can include a matched segment following the one used for frame 308. By using following matched segments, the computation to determine the matched segments for frames 308 and 310 is simplified compared to the extrapolation computation for frame 306.

In an example, an audio extrapolation technique can minimize artifacts when used in the context described above. The technique of audio extrapolation, described in details in the paragraphs below, can include extrapolating using overlapping blocks, with multiple and far-reaching cross-fadings when a new block is added. In an example, such as when using codec G.722, a match on the lower audio bands can be extrapolated, and the matching positions can be replicated in the higher audio bands without a noticeable quality impact.

An extrapolation technique can include operations to extend an existing audio segment of length N to a length N+T. An operation can include decomposing T=PL where L can represent a certain base block length and P is an integer, and then extrapolating one block at a time while modifying the length—L block just before the current blank to maximize smoothness. The technique can include operations to perform some arbitrary type of pattern matching to find a waveform in history that resembles the one in positions N−L+1 to N. The search can begin from N−2L+1 and go backwards in history. Once a matching waveform is found, the current data in N−L+1 to N can be cross-faded with the matching waveform, and the L samples in history that follow the best match can be used to fill the positions N+1 to N+L. The current blank position can then include N+L+1. The exact same procedure can be repeated P times until data up to N+T is covered. In an example, there are P matching tasks and P cross-fading operations to fill the audio up until N+T.

Figure 4A:
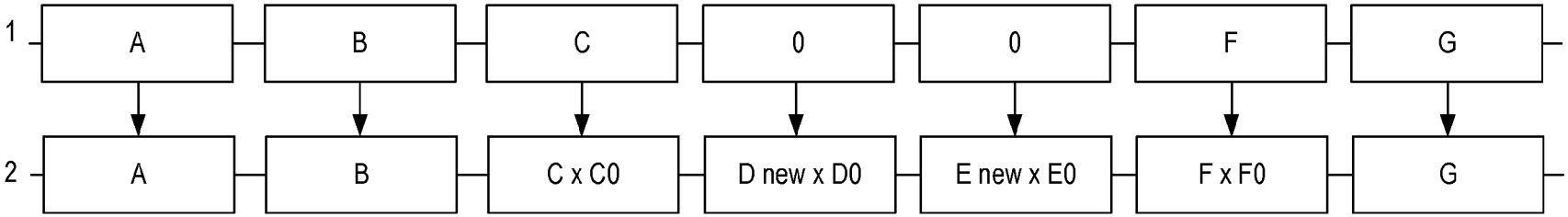
FIGS. 4A-4D illustrate generally frame by frame replacements in accordance with some embodiments of the present subject matter.

FIGS. 4A-4D illustrate generally frame by frame replacements in accordance with some embodiments of the present subject matter. In an example, the following frames (e.g., frames 402A-D, 404A-D, and 406A-D) are received and the frames in the places of D and E are dropped:

$$[A], [B], [C], [\emptyset], [\emptyset], [F], [G], \qquad \text{Eq. 1 as Shown in FIG. 4A}$$

Figure 4B:
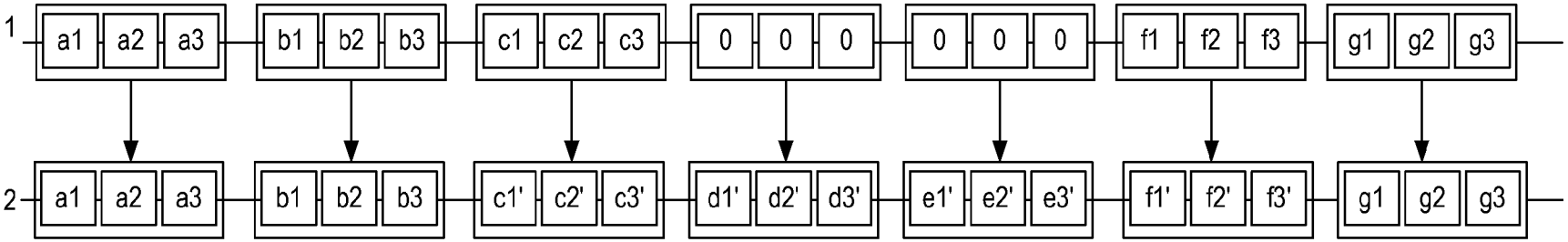
Figure 4C:
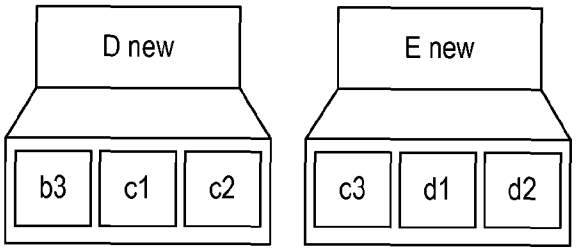

Each frame can contain 3 samples:

$$[a_1, a_2, a_3], [b_1, b_2, b_3], [c_1, c_2, c_3], [0, 0, 0], [0, 0, 0], [f_1, f_2, f_3], [g_1, g_2, g_3], \qquad \text{Eq. 2 as Shown in FIG. 4B}$$

Frames A, B, and C, are decoded normally, and before playing C back, the decoder is informed that the next frame (i.e., frame D) is dropped. The technique includes finding a match for frame C from its saved history, testing several positions up to the beginning of frame B. A new frame can be constructed $C_0$. In an example, an appropriate match includes the samples $[a_3, b_1, b_2]$ (see FIG. 4D). Frame C can be replaced with the cross-fading of C and $C_0$, yielding frame $\tilde{C}=C \otimes C_0$, which can then be played back. From here, a new frame D can be constructed, namely frame $\tilde{D}=[b_3, c_1, c_2]=[\tilde{d}_1, \tilde{d}_2, \tilde{d}_3]$ (see FIG. 4C) and that can be placed in the extrapolated data buffer.

Figure 4D:
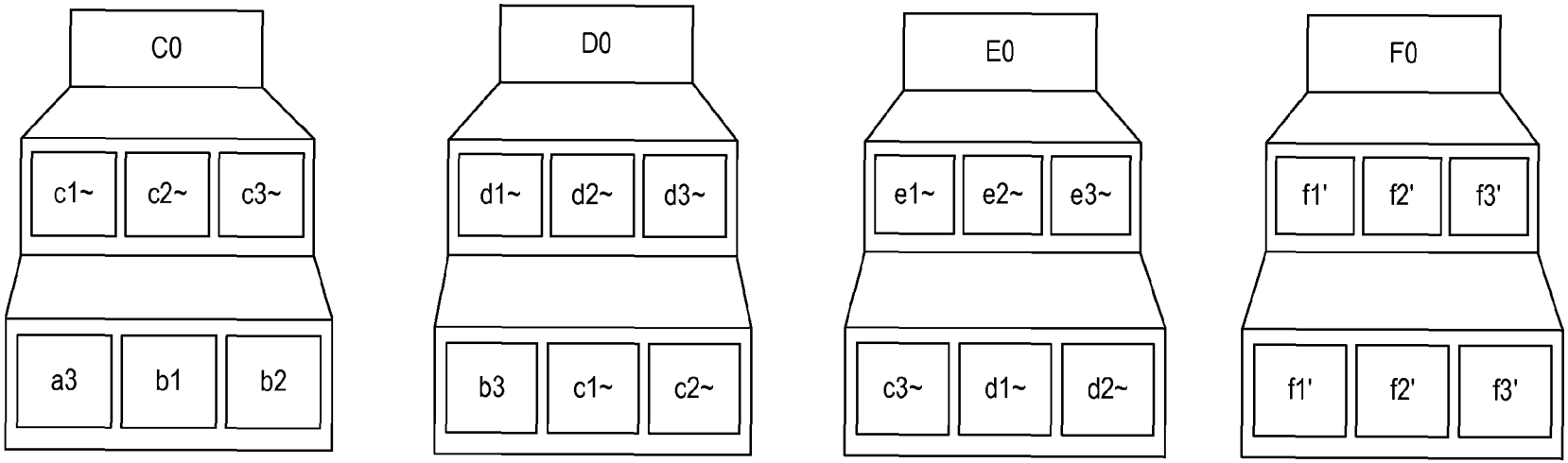

As the technique proceeds to the frame where $\tilde{D}$ is currently present, the decoder can also be informed that the next frame is dropped again. This time, a match from history to $\tilde{E}=[c_3, d_1, d_2]$ is determined, and the decoder is allowed to look all the way from the beginning of $\tilde{D}$. The history has slightly changed, and matches within the new history can be slightly different. In an example, the best match to $[c_3, d_1, d_2]$ can include $[\tilde{c}_3, \tilde{d}_1, \tilde{d}_2]$, which is exactly one frame forward from the match for new frame $D_0$ $[b_3, \tilde{c}_1, \tilde{c}_2]$. Cross-fading of $[\tilde{c}_3, \tilde{d}_1, \tilde{d}_2]$ and $[c_3, d_1, d_2]$ can be performed, which can ensure maximal smoothness of the extended waveform. In an example, the cross-fading operation can either partially be necessary (if the first few samples to be cross-faded are equal), or not necessary at all (if all samples are equal). As shown in FIGS. 4A and 4D, if the next frame F is valid (i.e., not dropped), it can be cross-faded with the next sequential match samples after those used for frame E. If frame G is also valid, then the technique can continue with no cross-fading for frame G.

FIGS. 5A-5D illustrate generally cross-faded samples for replacement frames in accordance with some embodiments of the present subject matter. As shown in FIG. 4B, the original frames can be replaced by new frames that include extrapolated or original samples cross-faded with matched samples:

$$[a_1, a_2, a_3], [b_1, b_2, b_3], [c_1', c_2', c_3'], [d_1', d_2', d_3'], [e_1', e_2', e_3'], [f_1', f_2', f_3'], [g_1, g_2, g_3], \qquad \text{Eq. 3 as Shown in FIG. 4B}$$

Figure 5A:
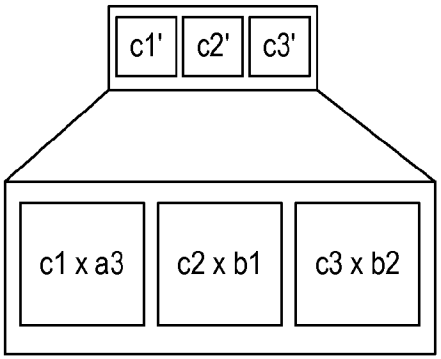
FIGS. 5A-5D illustrate generally cross-faded samples for replacement frames in accordance with some embodiments of the present subject matter.
Figure 5B:
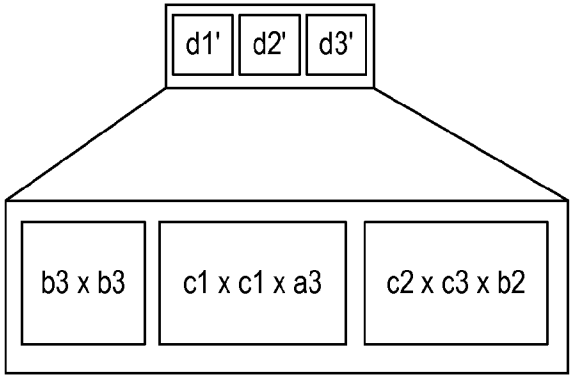
Figure 5C:
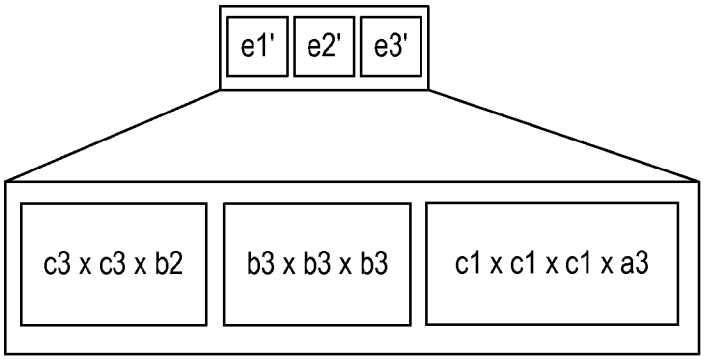
Figure 5D:
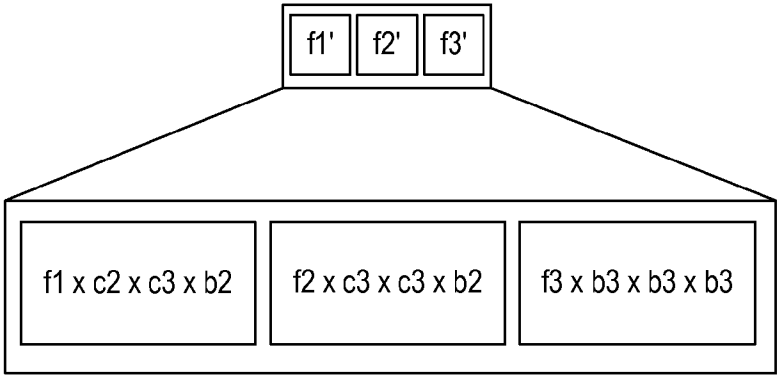

FIG. 5A shows frame $\tilde{C}$ as: $[c_1', c_2', c_3']$ including the original samples that are cross-faded to result in $\tilde{C}$. Similarly, FIGS. 5B-5C show frames $\tilde{D}$, $\tilde{E}$, and $\tilde{F}$ respectively, including the original samples that are cross-faded to result in those frames. In an example, an assumption can be made that one search is sufficient, and the next matches can be located one frame ahead from the initial match position, which can greatly reduce computational burden. In another example, while the cross-fade operations take place over a whole segment, the pattern match can be done over a central portion of a segment, where the cross-fading will have the most effect.

In practice, and in the context of packet loss concealment technique as described above, T can be equal to 2L where L is the frame length, and if the computational requirements allow, other combinations can be used (e.g., 4L' where L' is half of L, etc.). The extension can cover an extra frame, which can correspond to a non-dropped frame. If the extra frame is a non-dropped frame, another full-frame cross-fading operation can take place (e.g., for frame F above).

In the technique described above, multiple iterations can be used, instead of a single search far enough back to cover enough frames. The multiple iterations can increase the chances of finding a highly correlated concealment frame since the search can be started close to the dropped frame (e.g., due to short-time stationarity assumptions). The multiple iterations can also cover situations where multiple frames are dropped in the future or in a row. Using multiple iterations also decreases the computational complexity of determining subsequent searches through approximation to subsequent samples after a first set of matching samples is determined for a first cross-faded frame.

Figure 6:
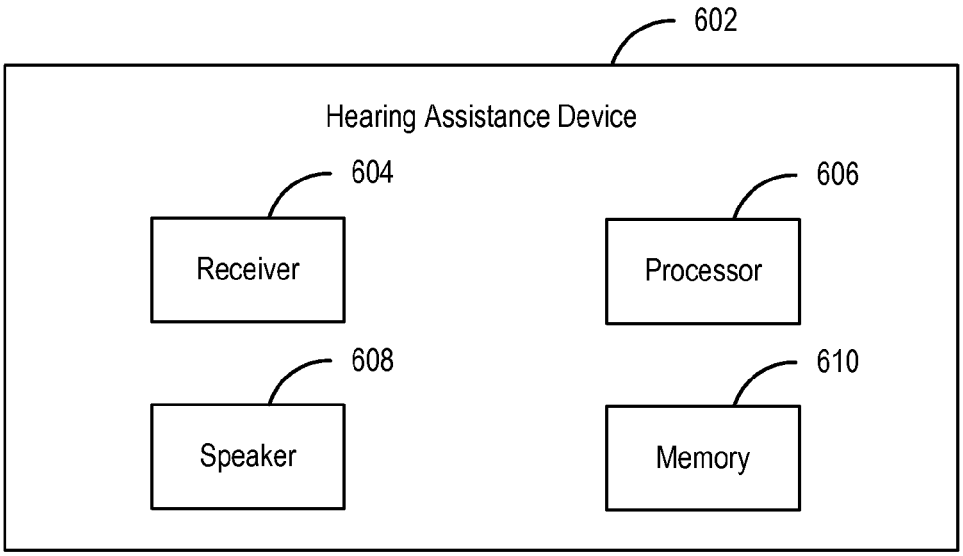
FIG. 6 illustrates generally a hearing assistance device in accordance with some embodiments of the present subject matter.

FIG. 6 illustrates generally a hearing assistance device 602 in accordance with some embodiments of the present subject matter. In an example, the hearing assistance device 602 can include a wireless receiver 604 to receive a first frame at the hearing assistance device 602. The receiver 604 can be in communication, such as using wireless signals, with a mobile device or music player, such as a phone.

The hearing assistance device 602 can include a processor 606 to determine that a second frame was not received by the receiver within a predetermined time and determine a first set of sequential samples that match the first frame. The processor 606 can cross-fade the first frame and the first set of sequential samples to create a first cross-faded frame and extrapolate a third frame to replace the second frame using the first set of sequential samples and an autoregressive model. The processor 606 can determine that a fourth frame was not received within a predetermined time. In an example, the processor 606 can cross-fade the third frame with the second set of samples to create a second cross-faded frame to replace the fourth frame. In another example, the processor 606 can determine parameters for the autoregressive model using one of a Burg method or a Yule-Walker method. Other methods to determine autoregressive parameters can be used without departing from the scope of the present subject matter. In yet another example, the processor 606 can encode the first frame using an adaptive differential pulse-code modulation.

The hearing assistance device 602 can include a speaker 608 to play an audio signal corresponding to the first cross-faded frame. In an example, the speaker 608 can play the third frame after the first cross-faded frame. In another example, the speaker 608 can play the second cross-faded frame. The hearing assistance device 602 can include memory 610 to store a buffer including samples, flags (e.g., a dropped frame flag), etc.

In an example, the third frame includes a second set of samples, and wherein the second set of samples includes samples starting one frame after the first set of sequential samples. In another example, the autoregressive model includes a model order of at least 50.

Figure 7:
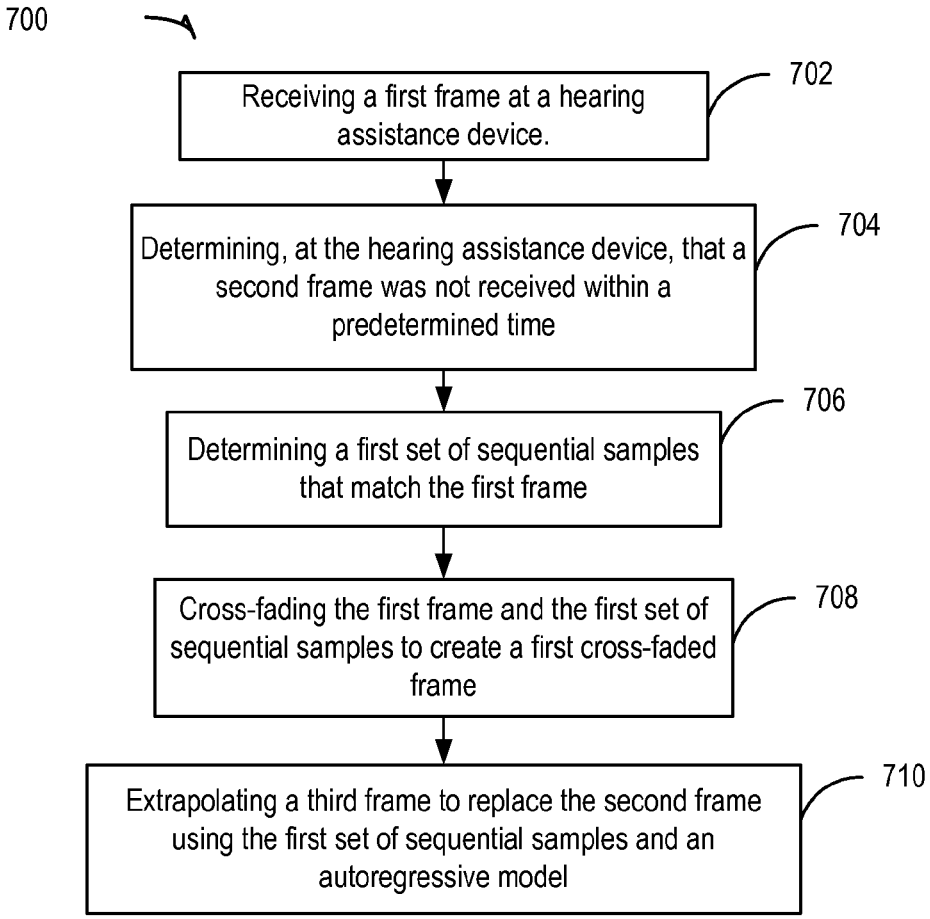
FIG. 7 illustrates generally a flowchart for packet loss concealment in accordance with some embodiments of the present subject matter.

FIG. 7 illustrates generally a flowchart 700 for packet loss concealment in accordance with some embodiments of the present subject matter. The flowchart 700 can include a method for packet loss concealment, the method comprising an operation 702 to receive a first frame at a hearing assistance device. The first frame can be received from a mobile device, such as a phone, a tablet, a dedicated music player, or the like.

The method can include an operation 704 to determine, at the hearing assistance device, that a second frame was not received within a predetermined time. The method can include an operation 706 to determine a first set of sequential samples that match the first frame. The method can include an operation 708 to cross-fade the first frame and the first set of sequential samples to create a first cross-faded frame. The method can include an operation 710 to extrapolate a third frame to replace the second frame using the first set of sequential samples and an autoregressive model.

The method can further include operations to play the first cross-faded frame or play the third frame after the first cross-faded frame. The method can include an operation to determine, at the hearing assistance device, that a fourth frame was not received within a predetermined time. The method can include an operation to cross-fade the third frame with the second set of samples to create a second cross-faded frame to replace the fourth frame. The method can include an operation to play the second cross-faded frame. In an example, the method includes an operation to determine parameters for the autoregressive model using a Burg method, a Yule-Walker method, and/or other methods for determining autoregressive parameters. The method can include an operation to encode the first frame using an adaptive differential pulse-code modulation (ADPCM).

The third frame can include a second set of samples, and wherein the second set of samples include samples starting one frame after the first set of sequential samples. The autoregressive model can include a model order, such as an order of 50 or greater.

In another example, any type of pattern matching can be used with the techniques described herein. The multiple cross-fadings performed over entire segments can include sound that is smooth and natural compared to other packet loss concealment techniques. In yet another example, two or more of the techniques described herein can be used together for packet loss concealment.

Figure 8:
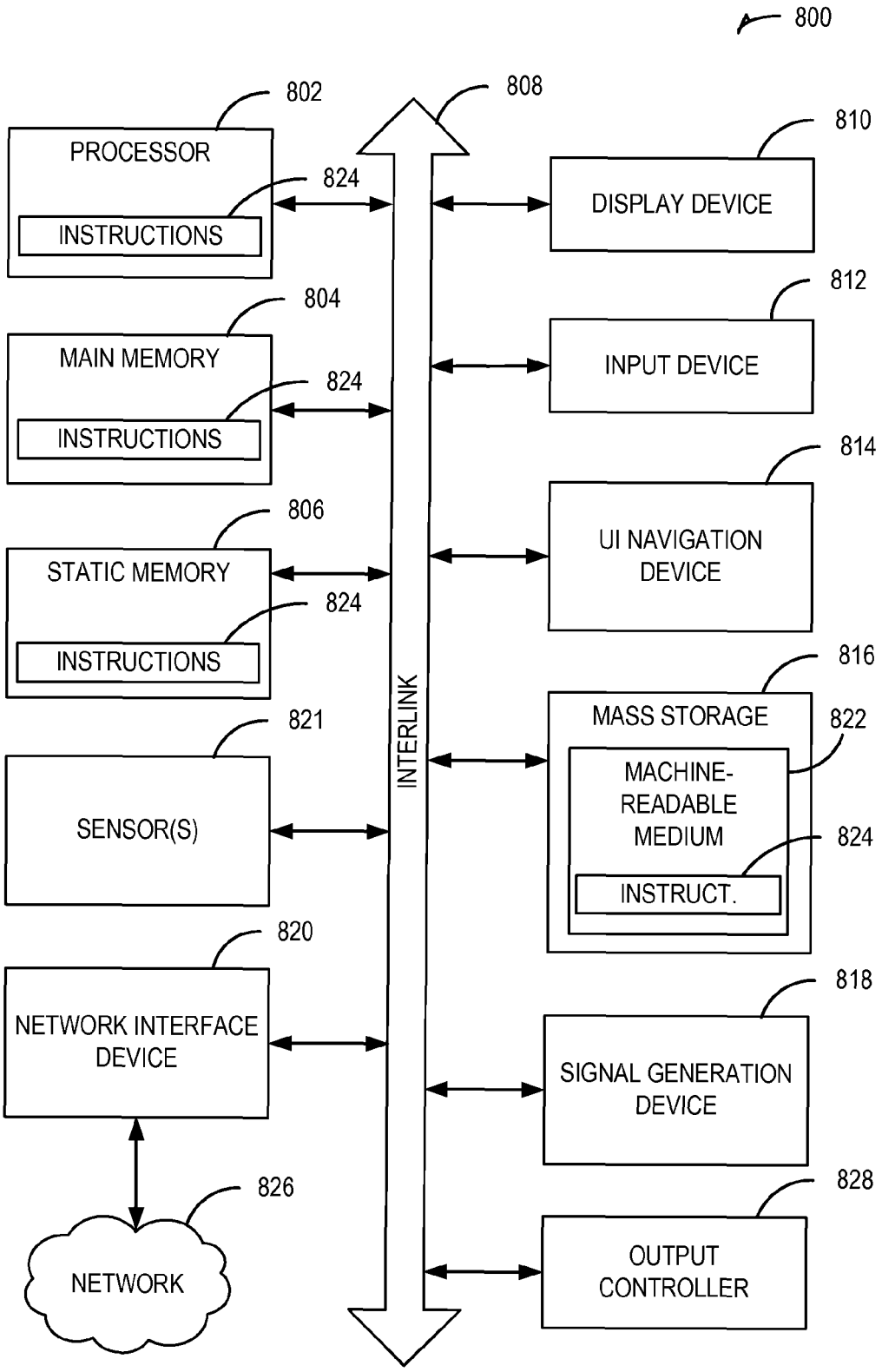
FIG. 8 illustrates generally an example of a block diagram of a machine upon which any one or more of the techniques discussed herein can perform in accordance with some embodiments of the present subject matter.

FIG. 8 illustrates generally an example of a block diagram of a machine 800 upon which any one or more of the techniques discussed herein can perform in accordance with some embodiments of the present subject matter. In various embodiments, the machine 800 can operate as a standalone device or can be connected (e.g., networked) to other machines. In a networked deployment, the machine 800 can operate in the capacity of a server machine, a client machine, or both in server-client network environments. In an example, the machine 800 can act as a peer machine in peer-to-peer (P2P) (or other distributed) network environment. The machine 800 can be a personal computer (PC), a tablet PC, a set-top box (STB), a personal digital assistant (PDA), a mobile telephone, a web appliance, a network router, switch or bridge, or any machine capable of executing instructions (sequential or otherwise) that specify actions to be taken by that machine. Machine 800 can include processor 606 of hearing assistance device 602 in FIG. 6. Further, while only a single machine is illustrated, the term "machine" shall also be taken to include any collection of machines that individually or jointly execute a set (or multiple sets) of instructions to perform any one or more of the methods described herein, such as cloud computing, software as a service (SaaS), other computer cluster configurations.

Examples, as described herein, can include, or can operate on, logic or a number of components, modules, or mechanisms. Modules are tangible entities (e.g., hardware) capable of performing specified operations when operating. A module includes hardware. In an example, the hardware can be specifically configured to carry out a specific operation (e.g., hardwired). In an example, the hardware can include configurable execution units (e.g., transistors, circuits, etc.) and a computer readable medium containing instructions, where the instructions configure the execution units to carry out a specific operation when in operation. The configuring can occur under the direction of the executions units or a loading mechanism. Accordingly, the execution units are communicatively coupled to the computer readable medium when the device is operating. In this example, the execution units can be a member of more than one module. For example, under operation, the execution units can be configured by a first set of instructions to implement a first module at one point in time and reconfigured by a second set of instructions to implement a second module.

Machine (e.g., computer system) 800 can include a hardware processor 802 (e.g., a central processing unit (CPU), a graphics processing unit (GPU), a hardware processor core, or any combination thereof), a main memory 804 and a static memory 806, some or all of which can communicate with each other via an interlink (e.g., bus) 808. The machine 800 can further include a display unit 810, an alphanumeric input device 812 (e.g., a keyboard), and a user interface (UI) navigation device 814 (e.g., a mouse). In an example, the display unit 810, alphanumeric input device 812 and UI navigation device 814 can be a touch screen display. The machine 800 can additionally include a storage device (e.g., drive unit) 816, a signal generation device 818 (e.g., a speaker), a network interface device 820, and one or more sensors 821, such as a global positioning system (GPS) sensor, compass, accelerometer, or other sensor. The machine 800 can include an output controller 828, such as a serial (e.g., universal serial bus (USB), parallel, or other wired or wireless (e.g., infrared (IR), near field communication (NFC), etc.) connection to communicate or control one or more peripheral devices (e.g., a printer, card reader, etc.).

The storage device 816 can include a machine readable medium 822 that is non-transitory on which is stored one or more sets of data structures or instructions 824 (e.g., software) embodying or utilized by any one or more of the techniques or functions described herein. The instructions 824 can also reside, completely or at least partially, within the main memory 804, within static memory 806, or within the hardware processor 802 during execution thereof by the machine 800. In an example, one or any combination of the hardware processor 802, the main memory 804, the static memory 806, or the storage device 816 can constitute machine readable media.

While the machine readable medium 822 is illustrated as a single medium, the term "machine readable medium" can include a single medium or multiple media (e.g., a centralized or distributed database, and/or associated caches and servers) configured to store the one or more instructions 824.

The term "machine readable medium" can include any medium that is capable of storing, encoding, or carrying instructions for execution by the machine 800 and that cause the machine 800 to perform any one or more of the techniques of the present disclosure, or that is capable of storing, encoding or carrying data structures used by or associated with such instructions. Non-limiting machine readable medium examples can include solid-state memories, and optical and magnetic media. Specific examples of machine readable media can include: nonvolatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; and CD-ROM and DVD-ROM disks.

The instructions 824 can further be transmitted or received over a communications network 826 using a transmission medium via the network interface device 820 utilizing any one of a number of transfer protocols (e.g., frame relay, internet protocol (IP), transmission control protocol (TCP), user datagram protocol (UDP), hypertext transfer protocol (HTTP), etc.). Example communication networks can include a local area network (LAN), a wide area network (WAN), a packet data network (e.g., the Internet), mobile telephone networks (e.g., cellular networks), Plain Old Telephone (POTS) networks, and wireless data networks (e.g., Institute of Electrical and Electronics Engineers (IEEE) 802.11 family of standards known as Wi-Fi®, IEEE 802.16 family of standards known as WiMax®), IEEE 802.15.4 family of standards, peer-to-peer (P2P) networks, among others. In an example, the network interface device 820 can include one or more physical jacks (e.g., Ethernet, coaxial, or phone jacks) or one or more antennas to connect to the communications network 826. In an example, the network interface device 820 can include a plurality of antennas to wirelessly communicate using at least one of single-input multiple-output (SIMO), multiple-input multiple-output (MIMO), or multiple-input single-output (MISO) techniques.

Hearing assistance devices typically include at least one enclosure or housing, a microphone, hearing assistance device electronics including processing electronics, and a speaker or "receiver." Hearing assistance devices can include a power source, such as a battery. In various embodiments, the battery can be rechargeable. In various embodiments multiple energy sources can be employed. It is understood that in various embodiments the microphone is optional. It is understood that in various embodiments the receiver is optional. It is understood that variations in communications protocols, antenna configurations, and combinations of components can be employed without departing from the scope of the present subject matter. Antenna configurations can vary and can be included within an enclosure for the electronics or be external to an enclosure for the electronics. Thus, the examples set forth herein are intended to be demonstrative and not a limiting or exhaustive depiction of variations.

It is understood that digital hearing aids include a processor. In digital hearing aids with a processor, programmable gains can be employed to adjust the hearing aid output to a wearer's particular hearing impairment. The processor can be a digital signal processor (DSP), microprocessor, microcontroller, other digital logic, or combinations thereof. The processing can be done by a single processor, or can be distributed over different devices. The processing of signals referenced in this application can be performed using the processor or over different devices. Processing can be done in the digital domain, the analog domain, or combinations thereof. Processing can be done using subband processing techniques. Processing can be done using frequency domain or time domain approaches. Some processing can involve both frequency and time domain aspects. For brevity, in some examples drawings can omit certain blocks that perform frequency synthesis, frequency analysis, analog-to-digital conversion, digital-to-analog conversion, amplification, buffering, and certain types of filtering and processing.

In various embodiments the processor is adapted to perform instructions stored in one or more memories, which can or cannot be explicitly shown. Various types of memory can be used, including volatile and nonvolatile forms of memory. In various embodiments, the processor or other processing devices execute instructions to perform a number of signal processing tasks. Such embodiments can include analog components in communication with the processor to perform signal processing tasks, such as sound reception by a microphone, or playing of sound using a receiver (i.e., in applications where such transducers are used). In various embodiments, different realizations of the block diagrams, circuits, and processes set forth herein can be created by one of skill in the art without departing from the scope of the present subject matter.

Various embodiments of the present subject matter support wireless communications with a hearing assistance device. In various embodiments the wireless communications can include standard or nonstandard communications. Some examples of standard wireless communications include, but not limited to, Bluetooth™, low energy Bluetooth, IEEE 802.11 (wireless LANs), 802.15 (WPANs), and 802.16 (WiMAX). Cellular communications can include, but not limited to, CDMA, GSM, ZigBee, and ultra-wideband (UWB) technologies. In various embodiments, the communications are radio frequency communications. In various embodiments the communications are optical communications, such as infrared communications. In various embodiments, the communications are inductive communications. In various embodiments, the communications are ultrasound communications. Although embodiments of the present system can be demonstrated as radio communication systems, it is possible that other forms of wireless communications can be used. It is understood that past and present standards can be used. It is also contemplated that future versions of these standards and new future standards can be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, ATM, Fibre-channel, Firewire or 1394, InfiniBand, or a native streaming interface. In various embodiments, such connections include all past and present link protocols. It is also contemplated that future versions of these protocols and new protocols can be employed without departing from the scope of the present subject matter.

In various embodiments, the present subject matter is used in hearing assistance devices that are configured to communicate with mobile phones. In such embodiments, the hearing assistance device can be operable to perform one or more of the following: answer incoming calls, hang up on calls, and/or provide two way telephone communications. In various embodiments, the present subject matter is used in hearing assistance devices configured to communicate with packet-based devices. In various embodiments, the present subject matter includes hearing assistance devices configured to communicate with streaming audio devices. In various embodiments, the present subject matter includes hearing assistance devices configured to communicate with Wi-Fi devices. In various embodiments, the present subject matter includes hearing assistance devices capable of being controlled by remote control devices.

It is further understood that different hearing assistance devices can embody the present subject matter without departing from the scope of the present disclosure. The devices depicted in the figures are intended to demonstrate the subject matter, but not necessarily in a limited, exhaustive, or exclusive sense. It is also understood that the present subject matter can be used with a device designed for use in the right ear or the left ear or both ears of the wearer.

The present subject matter can be employed in hearing assistance devices, such as headsets, headphones, and similar hearing devices.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids can include devices that reside substantially behind the ear or over the ear. Such devices can include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard fitted, open fitted and/or occlusive fitted. It is understood that other hearing assistance devices not expressly stated herein can be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code can form portions of computer program products. Further, in an example, the code can be tangibly stored on one or more volatile, non-transitory, or nonvolatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

What is claimed is:

1. A method for packet loss concealment, comprising:

receiving a first frame of a wireless transmission at a hearing assistance device;

saving a history of received packets to a memory;

determining, at the hearing assistance device, that a second frame was not received within a predetermined time;

determining from the history a first set of sequential samples including a first portion that matches the first frame;

cross-fading the first frame and the first portion of the first set of sequential samples to create a first cross-faded frame, and replacing the first frame with the first cross-faded frame; and extrapolating a third frame to replace the second frame using a second portion of the first set of sequential samples and an autoregressive model.

2. The method of claim 1, wherein the first frame is received from a mobile device.

3. The method of claim 1, further comprising playing the first cross-faded frame.

4. The method of claim 3, further comprising playing the third frame after the first cross-faded frame.

5. The method of claim 1, wherein the third frame includes a second set of samples, and wherein the second set of samples include samples starting one frame after the first set of sequential samples.

6. The method of claim 5, further comprising determining, at the hearing assistance device, that a fourth frame was not received within a predetermined time.

7. The method of claim 6, further comprising cross-fading the third frame with the second set of samples to create a second cross-faded frame to replace the fourth frame.

8. The method of claim 7, further comprising playing the second cross-faded frame.

9. The method of claim 1, further comprising encoding the first frame using an adaptive differential pulse-code modulation.

10. The method of claim 1, wherein the autoregressive model includes a model order of at least 50.

11. A hearing assistance device, comprising:

a wireless receiver; and a processor configured to:

receive a first frame of a wireless transmission at the hearing assistance device;

save a history of received packets to a memory;

determine from the history a first set of sequential samples including a first portion that matches the first frame;

determine that a second frame was not received within a predetermined time;

cross-fade the first frame and the first portion of the first set of sequential samples to create a first cross-faded frame, and replace the first frame with the first cross-faded frame; and extrapolate a third frame to replace the second frame using a second portion of the first set of sequential samples and an autoregressive model.

12. The device of claim 11, wherein the receiver is configured to receive the first frame after it is transmitted from a mobile device.

13. The device of claim 11, further comprising a speaker configured to play information using the first cross-faded frame.

14. The device of claim 13, wherein the speaker is configured to play the third frame after the first cross-faded frame.

15. The device of claim 11, wherein the third frame includes a second set of samples, and wherein the second set of samples include samples starting one frame after the first set of sequential samples.

16. The device of claim 15, wherein the processor is configured to determine that a fourth frame was not received within a second predetermined time.

17. The device of claim 16, wherein the processor is configured to cross-fade the third frame with the second set of samples to create a second cross-faded frame to replace the fourth frame.

18. The device of claim 17, further comprising a speaker configured to play information using the second cross-faded frame.

19. The device of claim 11, wherein the processor is to encode the first frame using an adaptive differential pulse-code modulation.

20. The device of claim 11, wherein the autoregressive model includes a model order of at least 50.

* * * * *